US010103457B2

(12) United States Patent
Nakata

(10) Patent No.: US 10,103,457 B2
(45) Date of Patent: Oct. 16, 2018

(54) TERMINAL ATTACHED WIRE

(71) Applicant: Yazaki Corporation, Tokyo (JP)

(72) Inventor: Hirohito Nakata, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/674,775

(22) Filed: Aug. 11, 2017

(65) Prior Publication Data

US 2018/0048080 A1 Feb. 15, 2018

(30) Foreign Application Priority Data

Aug. 12, 2016 (JP) ..... 2016-158822

(51) Int. Cl.
*H01R 4/60* (2006.01)
*H01R 4/62* (2006.01)
*H01R 4/18* (2006.01)

(52) U.S. Cl.
CPC ..... *H01R 4/62* (2013.01); *H01R 4/183* (2013.01)

(58) Field of Classification Search
CPC ..... H01R 4/18; H01R 4/185; H01R 4/188; H01R 4/184; H01R 43/048
USPC ..... 439/203, 877, 879, 887
See application file for complete search history.

(56) References Cited

U.S. PATENT DOCUMENTS 8,245,396 B2 * 8/2012 Kondo ..... H01R 4/185 174/84 R
9,391,384 B2 * 7/2016 Kodama ..... H01R 4/62
2014/0302729 A1 * 10/2014 Kodama ..... H01R 4/62 439/877
2016/0365648 A1 12/2016 Aoki

FOREIGN PATENT DOCUMENTS

JP 2013-134891 A 7/2013
JP 2013149598 A 8/2013
JP 2015-191776 A 11/2015

OTHER PUBLICATIONS

Communication dated Jul. 24, 2018, issued by the Japanese Office Action in counterpart Japanese Application No. 2016-158822.

* cited by examiner

*Primary Examiner* — Phuong Chi T Nguyen
(74) *Attorney, Agent, or Firm* — Sughrue Mion, PLLC

(57) ABSTRACT

A terminal attached wire includes a wire and a terminal fitting. The wire includes a core wire. The core wire is made of aluminum or an aluminum alloy and is covered with a coating. The core wire is exposed at and end portion of the wire. The terminal fitting is made of copper or a copper alloy and is connected to the end portion of the wire. A sacrifice layer having a higher ionization tendency than aluminum is provided on a portion of the terminal fitting except for an electrical connection portion with another member.

3 Claims, 4 Drawing Sheets

TERMINAL ATTACHED WIRE

CROSS REFERENCE TO RELATED APPLICATIONS

This application is based on Japanese Patent Application (No. 2016-158822) filed on Aug. 12, 2016, the contents of which are incorporated herein by way of reference.

BACKGROUND

The present invention relates to a terminal attached wire having an end portion to which a terminal fitting is connected.

For example, for a wire harness arranged in a vehicle, a terminal attached wire having a terminal fitting made of copper or a copper alloy that is subjected to a crimp connection to a wire having a core wire made of aluminum or an aluminum alloy is used for weight saving. Incidentally, there is a concern that, in the terminal attached wire, water attached between the core wire of the wire and the terminal fitting which are dissimilar metals will work as an electrolyte, and thus galvanic corrosion will occur.

Therefore, a coating material is attached at a predetermined position in a crimp region of the terminal fitting that is crimped to the wire such that an occurrence of corrosion is reduced at a connection position of the wire and the core wire (for example, see Patent Document 1).

[Patent Document 1] JP 2013-149598 A

SUMMARY

The present invention is made in such circumstances described above, and an object thereof is to provide a terminal attached wire that has high corrosion resistance while suppressing costs.

In order to achieve the object described above, a terminal attached wire according to the present invention has (i) to (iii) as below.

(i) A terminal attached wire including:

a wire including a core wire which is made of aluminum or an aluminum alloy and is covered with a coating, the core wire being exposed at an end portion of the wire; and a terminal fitting made of copper or a copper alloy and connected to the end portion of the wire, wherein a sacrifice layer having a higher ionization tendency than aluminum is provided on a portion of the terminal fitting except for an electrical connection portion with another member.

(ii) The terminal attached wire according to the above (i), wherein the sacrifice layer is a plated layer made of zinc.

(iii) The terminal attached wire according to the above (i) or (ii), wherein the terminal fitting includes a conductor crimping portion crimped to the core wire, the sacrifice layer is formed on a surface of the conductor crimping portion opposite to a surface of the conductor crimping portion on which the core wire is crimped.

BRIEF DESCRIPTION OF DRAWINGS

FIG. 4A is a schematic side view of the base material, and FIG. 4B is a schematic back view of the base material.

FIG. 5A is a schematic side view of the base material, and FIG. 5B is a schematic back view of the base material.

DETAILED DESCRIPTION OF EXEMPLIFIED EMBODIMENT

In a technology in Patent Document 1, when the coating material is not accurately attached at the predetermined position such as a contact surface between an edge portion of a crimp piece and the core wire, time and effort are required for work, thereby resulting in an increase in costs.

The present invention is made in such circumstances described above, and an object thereof is to provide a terminal attached wire that has high corrosion resistance while suppressing costs.

Hereinafter, examples of embodiments according to the present invention will be described with reference to the figures.

Figure 1:
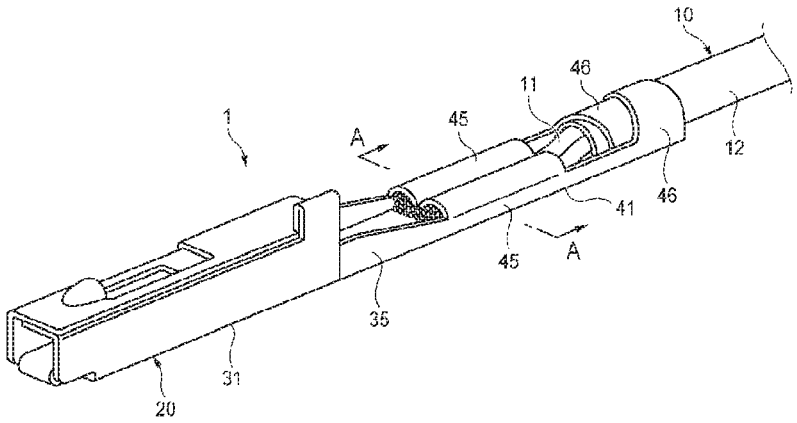
FIG. 1 is a perspective view of a terminal attached wire according to this embodiment.

FIG. 1 is a perspective view of a terminal attached wire according to this embodiment.

As illustrated in FIG. 1, a terminal attached wire 1 according to the embodiment includes a wire 10 and a terminal fitting 20. The wire 10 has an end portion to which the terminal fitting 20 is crimped and electrically connected. For example, the terminal attached wire 1 configures a wire harness that is arranged in a vehicle such as an automobile.

The wire 10 is an insulated wire having a core wire 11 and coating 12 made of a resin that covers the core wire 11. The core wire 11 is made of aluminum or an aluminum alloy, and is configured to have a plurality of twisted wires. As described above, the core wire 11 of the wire 10 is made of the aluminum or the aluminum alloy, and thereby the terminal attached wire 1 is lightweight such that the wire harness configured to have the terminal attached wires 1 is to be lightweight. The lightweight terminal attached wire 1 is suitable to be used in a vehicle such as, particularly, an electric car or a hybrid car in which the wire harness is often used.

The terminal fitting 20 has an electrical connection portion 31 in a front portion and a wire connection portion 41 in a rear portion. The electrical connection portion 31 and the wire connection portion 41 are connected to each other by a linking portion 35.

The terminal fitting 20 is formed by performing the press processing (a punching process and a bending process) on a base material made of a metal plate. The terminal fitting 20 is made of a different metal material from the core wire 11 of the wire 10 that is made of aluminum or an aluminum alloy. In the example, the terminal fitting 20 is formed from a metal plate made of copper or a copper alloy, as a base material.

The electrical connection portion 31 is formed to have a cylindrical shape having a distal portion that is opened, the terminal fitting of a connection counterpart to an opening portion is inserted and is electrically connected to the electrical connection portion 31.

The wire connection portion 41 is crimped and is electrically connected to the end portion of the wire 10. The wire connection portion 41 has a pair of conductor crimping portions 45 on the front side and has a pair of coating crimping portions 46. The wire connection portion 41 has a side of an upper surface as one surface which is a mounting surface 41*a* on which the end portion of the wire 10 is disposed.

Figure 2:
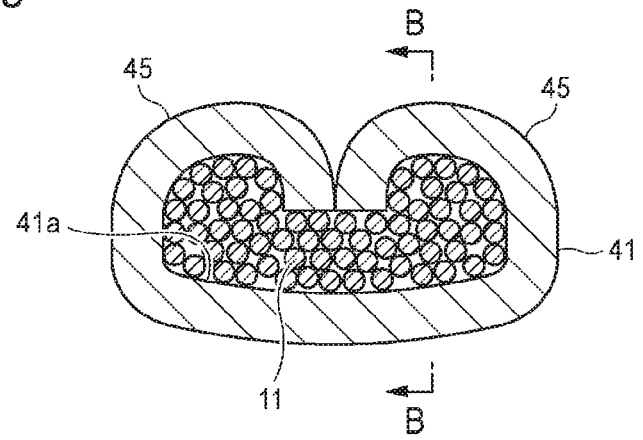
FIG. 2 is a sectional view taken along line A-A in FIG. 1.

FIG. 2 is a sectional view taken along line A-A in FIG. 1.

As illustrated in FIG. 2, in a state in which the end portion of the wire 10, at which the core wire 11 is exposed, is disposed on the mounting surface 41*a*, the pair of conductor crimping portions 45 is crimped to the wire connection portion 41 from both sides. In this manner, the conductor crimping portion 45 is crimped and electrically connected to the core wire 11 of the wire 10.

In addition, the coating crimping portion 46 is bent to surround a region of the coating 12 of the end portions of the wire 10 that are disposed on the mounting surface 41*a*, and is crimped such that the end portions overlap each other.

Figure 3:
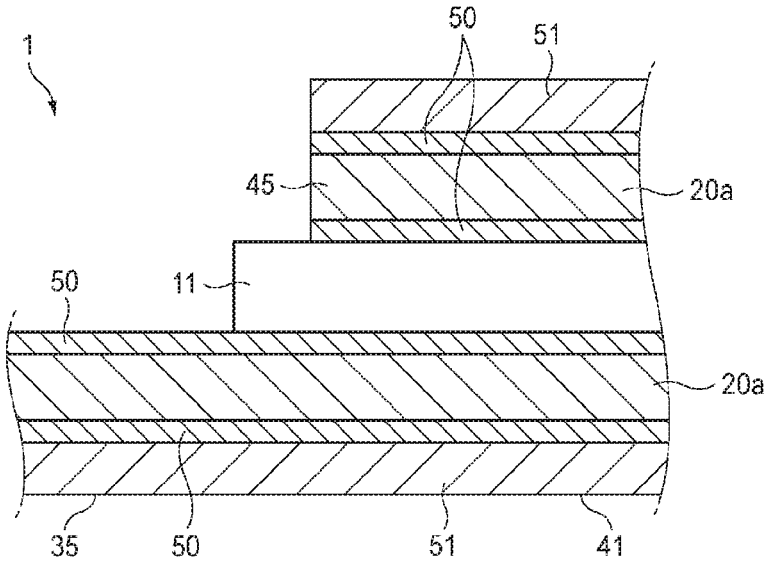
FIG. 3 is a sectional view taken along line B-B in FIG. 1.

FIG. 3 is a sectional view taken along line B-B in FIG. 2.

As illustrated in FIG. 3, a base material 20*a* of the terminal fitting 20 has tin plated layers 50 on the front and back surfaces thereof. Further, the terminal fitting 20 has a sacrifice layer 51 in the wire connection portion 41. The sacrifice layer 51 is provided on an outer surface of the conductor crimping portion 45 that is opposite to an inner surface side thereof that comes into contact with the core wire 11, and is formed to overlap the tin plated layer 50. In this manner, the sacrifice layer 51 is disposed in the vicinity of the core wire 11 of the wire 10 that is connected to the wire connection portion 41. The sacrifice layer 51 is made of base metal having a higher ionization tendency than aluminum, and thus the sacrifice layer is formed of a plated layer of zinc (Zn) in the example. The sacrifice layer 51 is about 10 μm to 20 μm in thickness. As described above, the sacrifice layer 51 is provided in a region of the terminal fitting 20 except for an electrical connection portion to another member such as a terminal fitting of a connection counterpart or the core wire 11 of the wire 10.

Figure 4A:
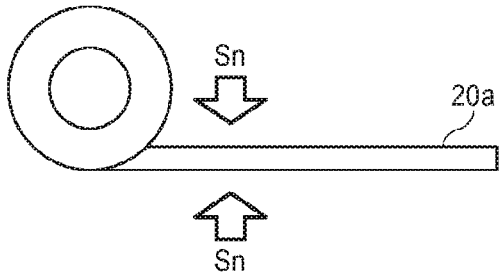
FIGS. 4A and 4B illustrate views showing a process of performing tin plating on a base material of a terminal fitting.
Figure 4B:
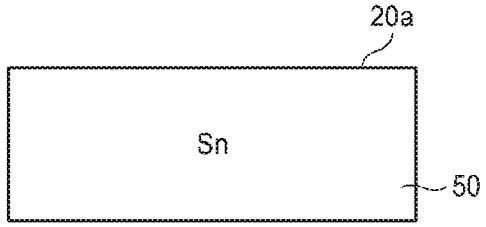
Figure 5A:
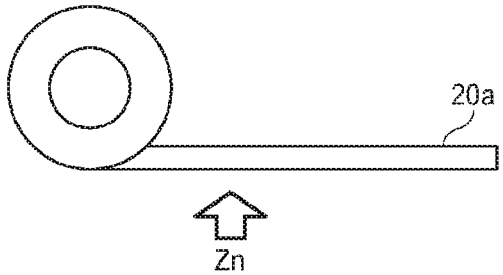
FIGS. 5A and 5B illustrate views showing a process of performing zinc plating on the base material of the terminal fitting.
Figure 5B:
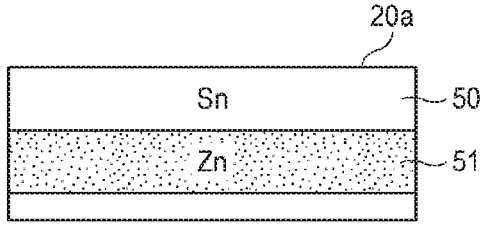
Figure 6:
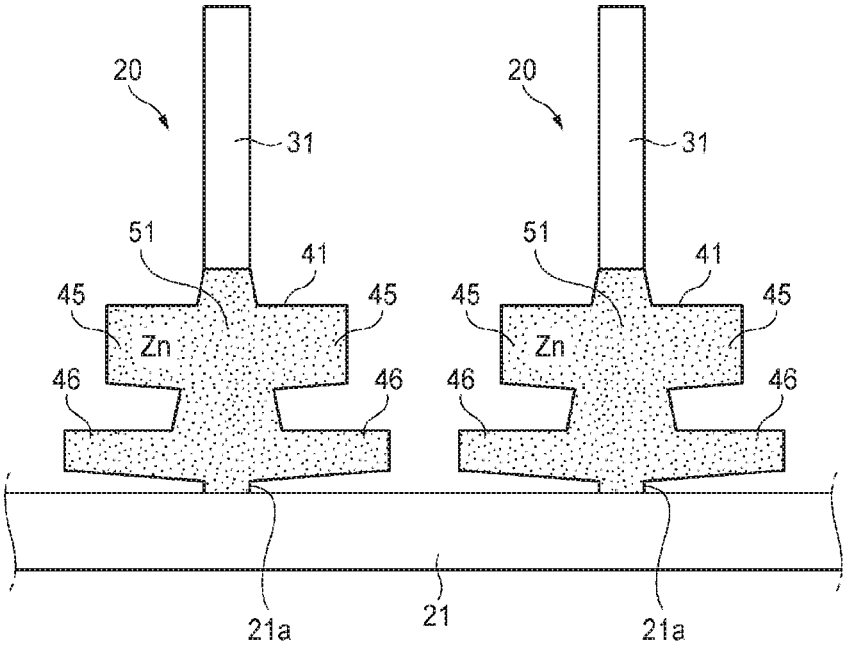
FIG. 6 is a back view of a catenulate terminal fitting after the press processing.

FIG. 4 illustrates views showing a process of performing tin plating on the base material of the terminal fitting, FIG. 4A is a schematic side view of the base material, and FIG. 4B is a schematic back view of the base material. FIG. 5 illustrates views showing a process of performing zinc plating on the base material of the terminal fitting, FIG. 5A is a schematic side view of the base material, and FIG. 5B is a schematic back view of the base material. FIG. 6 is a back view of a catenulate terminal fitting after the press processing.

In preparation of the terminal fitting 20 having the sacrifice layer 51, first, as illustrated in FIGS. 4A and 4B, while the elongated base material 20*a* of the terminal fitting 20 that is made of a metal plate of copper or a copper alloy is drawn, the tin plated layer 50 is formed on the front and back surfaces of the terminal fitting 20. As illustrated in FIGS. 5A and 5B, while the elongated base material 20*a* having the front and back surfaces, on which the tin plated layer 50 is formed, is drawn, plating of zinc (Zn) is performed to have a strip shape on one surface in a drawing direction such that the sacrifice layer 51 is formed. Then, as illustrated in FIG. 6, the base material 20*a*, on which the sacrifice layer 51 is formed, is subjected to the press processing, and thereby the terminal fittings 20 are linked to a strip-shaped carrier 21 at linking positions 21*a* such that the terminal fittings linked to have a catenulate shape is formed. At this time, the press processing is performed so as to dispose the sacrifice layer 51 on the back surface of the terminal fitting 20 which is a surface on an opposite side to the mounting surface 41*a* of the wire connection portion 41.

The terminal fitting 20 having the sacrifice layer 51 is cut at the linking positions 21*a* to the carrier 21 so as to be separated from the carrier 21 and the conductor crimping portion 45 and the coating crimping portion 46 are crimped in a state in which the end portion of the wire 10 is disposed on the mounting surface 41*a* of the wire connection portion 41. In this manner, the conductor crimping portion 45 is crimped to the core wire 11 of the wire 10 and the coating crimping portion 46 is crimped to the coating 12 of the wire 10.

In this manner, in the terminal attached wire 1 in which the terminal fitting 20 is crimped to be connected to the end portion of the wire 10, the sacrifice layer 51 made of a plated layer of zinc of the base metal having the higher ionization tendency than aluminum is disposed in the vicinity of the core wire 11. Hence, when water is attached to the terminal fitting 20, the sacrifice layer 51 corrodes prior to the core wire 11 made of aluminum or an aluminum alloy, and thus the corrosion of the core wire 11 of the wire 10 is suppressed.

As described above, in the terminal attached wire 1 according to the embodiment, the sacrifice layer 51 provided in the region of the terminal fitting 20 except for the electrical connection portion to another member corrodes prior to the core wire 11 of the wire 10, and thereby it is possible to suppress corrosion of the core wire 11 such that it is possible to suppress an increase in resist due to the corrosion of the core wire 11 of the wire 10. In addition, compared to a case where a coating material is accurately applied or plated at a predetermined position of the terminal fitting 20 in order to suppress the corrosion, it is possible to achieve high connection reliability of the terminal fitting 20 with the core wire 11 of the wire 10 while the costs is suppressed.

Here, in a case where the press processing is performed on the base material 20*a* made of pre-plated material with which tin plating is performed on the front and back surfaces and the tin plated layer 50 is formed, and the terminal fitting 20 is formed, the base material 20*a* made of copper or a copper alloy is exposed from the cut surface, and there is a concern that galvanic corrosion will occur in the core wire 11 made of aluminum or an aluminum alloy. In such a case, the sacrifice layer 51 provided on the terminal fitting 20 first corrodes, and thus it is possible to suppress the corrosion of the core wire 11 of the wire 10.

In addition, since the sacrifice layer 51 is the plated layer made of zinc, zinc plating is performed in the region of the terminal fitting 20 except for the electrical connection portion with another member, and thereby it is possible to easily form the sacrifice layer 51 on the terminal fitting 20.

In addition, since the sacrifice layer 51 is formed on the surface of the conductor crimping portion 45 on the opposite side to the core wire 11, the conductor crimping portion being crimped to the core wire 11, the conductor crimping portion 45 is crimped and is crimped to the core wire 11, and thereby the sacrifice layer 51 is disposed in the vicinity of the core wire 11. Hence, it is possible to effectively suppress the corrosion of the core wire 11.

Note that, as long as a formation position of the sacrifice layer 51 is a region except for the electrical connection portion, the sacrifice layer may be formed on the outer side of the wire connection portion 41. In other words, it is possible to form the sacrifice layer 51 in a region except for the inner surface of the conductor crimping portion 45 that is electrically connected to the core wire 11 or the inner side of the electrical connection portion 31 into which the terminal fitting of the connection counterpart is inserted and to which the terminal fitting is electrically connected. For example, as the formation position of the sacrifice layer 51, the sacrifice layer may be formed on an outer circumferential surface of the electrical connection portion 31 or on the linking portion 35 that links between the electrical connection portion 31 and the wire connection portion 41.

In addition, in the embodiments described above, the sacrifice layer 51 is formed to have a strip shape throughout the surface of the drawn elongated base material 20*a* which is opposite to the surface which is the mounting surface 41*a* of the wire connection portion 41 (refer to FIG. 5B); however, the sacrifice layer may be formed to have a plurality of line shapes at positions of the drawn elongated base material 20*a* which is the region except for the electrical connection portion. In addition, the sacrifice layer 51 may be formed on the drawn elongated base material 20*a* on the entire back surface of the base material 20*a* which is a region except for the electrical connection portion. As described above, the sacrifice layer 51 is provided on the entire back surface of the base material 20*a*, and thereby it is possible to have high corrosion allowance of the sacrifice layer 51. In addition, it is possible to achieve a decrease in cost without time and effort to form the sacrifice layer 51 in a predetermined range.

Further, in the embodiments described above, the sacrifice layer 51 is formed on the base material 20*a* in advance before the terminal fitting 20 is formed; however, the terminal fitting 20 may be formed from the tin-plated base material 20*a*, the terminal fitting 20 may be subjected to the crimp connection to the wire 10, and then the sacrifice layer 51 may be formed in a region of terminal fitting 20 except for the electrical connection portion.

In addition, in the embodiments described above, an example of the terminal fitting 20 in which the conductor crimping portion 45 is crimped to the core wire 11 of the wire 10 and the coating crimping portion 46 is crimped to the coating 12 of the wire 10 is described; however, as the terminal fitting 20, an overlap type of terminal fitting having a pair of crimp pieces linked between the conductor crimping portion 45 and the coating crimping portion 46, in which the crimp pieces are bent to surround the end portion of the wire 10 and the end portions of the crimp pieces are crimped to the wire 10 so as to overlap each other may be employed. According to the overlap type of terminal fitting 20, a high water-stopping effect is achieved at connection positions to the wire 10.

Note that the present invention is not limited to the embodiments described above, and it is possible to appropriately perform modification, alteration, or the like. Additionally, materials, shapes, dimensions, the number, positions, or the like of the configurational elements in the embodiments described above are arbitrary and are not limited thereto as long as it is possible to achieve the present invention.

Here, features of the embodiments of the terminal attached wire according to the present invention described above are collectively listed in respective (i) to (iii) in brief.

(i) The terminal attached wire (1) including:

a wire (10) including a core wire (11) which is made of aluminum or an aluminum alloy and is covered with a coating (12), the core wire (11) being exposed at an end portion of the wire (10); and a terminal fitting (20) made of copper or a copper alloy and connected to the end portion of the wire (10), wherein a sacrifice layer (51) having the higher ionization tendency than aluminum is provided on a portion of the terminal fitting (20) except for the electrical connection portion with another member.

(ii) In the terminal attached wire according to (i), the sacrifice layer (51) may be a plated layer made of zinc.

(iii) In the terminal attached wire according to (i) or (ii), the terminal fitting (20) includes a conductor crimping portion (45) crimped to the core wire (11), and the sacrifice layer (51) is formed on the surface of the conductor crimping portion (45) opposite to a surface of the conductor crimping portion (45) on which the core wire (11) is crimped.

In the terminal attached wire having a configuration of (i) described above, the sacrifice layer provided in the region of the terminal fitting except for the electrical connection portion to another member corrodes prior to the core wire of the wire, and thereby it is possible to suppress corrosion of the core wire of the wire. Hence, it is possible to suppress an increase in resistance due to the corrosion of the core wire of the wire. In addition, compared to a case where a coating material is accurately applied or plated at a predetermined position of the terminal fitting in order to suppress corrosion, it is possible to achieve high connection reliability of the terminal fitting with the core wire of the wire while the costs are suppressed.

In the terminal attached wire having a configuration of (ii) described above, zinc plating is performed in a region of the terminal fitting except for the electrical connection portion with another member, and thereby it is possible to easily form the sacrifice layer on the terminal fitting.

In the terminal attached wire having a configuration of (iii) described above, the conductor crimping portion is crimped and is crimped to the core wire, and thereby the sacrifice layer is disposed in the vicinity of the core wire. Hence, it is possible to effectively suppress the corrosion of the core wire.

According to the present invention, it is possible to provide the terminal attached wire having the high corrosion resistance while suppressing the costs.

What is claimed is:

1. A terminal attached wire comprising:

a wire including a core wire which is made of aluminum or an aluminum alloy and is covered with a coating, the core wire being exposed at an end portion of the wire; and a terminal fitting made of copper or a copper alloy and connected to the end portion of the wire, wherein a sacrifice layer having a higher ionization tendency than aluminum is provided on a portion of the terminal fitting, the terminal fitting includes a conductor crimping portion crimped to the core wire, and the sacrifice layer is formed on a surface of the conductor crimping portion opposite to a surface of the conductor crimping portion on which the core wire is crimped.

2. The terminal attached wire according to claim 1, wherein the sacrifice layer is a plated layer made of zinc.

3. The terminal attached wire according to claim 1, wherein the sacrifice layer is not formed on the surface of the conductor crimping portion on which the core wire is crimped.

* * * * *